US007147902B2

(12) United States Patent
Kidnie et al.

(10) Patent No.: US 7,147,902 B2
(45) Date of Patent: Dec. 12, 2006

(54) MULTI-LAYER LASER THERMAL IMAGE RECEPTOR SHEET WITH INTERNAL TIE LAYER

(75) Inventors: Kevin M. Kidnie, St. Paul, MN (US); Michael B. Heller, Inver Grove Heights, MN (US); M. Zaki Ali, Mendota Heights, MN (US)

(73) Assignee: Eastman Kodak Company, Rochester, NY (US)

( * ) Notice: Subject to any disclaimer, the term of this patent is extended or adjusted under 35 U.S.C. 154(b) by 243 days.

(21) Appl. No.: 10/789,039

(22) Filed: Feb. 27, 2004

(65) Prior Publication Data

US 2005/0191447 A1 Sep. 1, 2005

(51) Int. Cl.
*B41M 5/40* (2006.01)

(52) U.S. Cl. ..... 428/32.51; 428/32.81

(58) Field of Classification Search ... 428/32.39–32.87
See application file for complete search history.

(56) References Cited

U.S. PATENT DOCUMENTS

| | | | |
|---|---|---|---|
| 2,701,245 | A | 2/1955 | Lynn |
| 4,876,235 | A | 10/1989 | DeBoer |
| 4,885,225 | A | 12/1989 | Heller et al. |
| 5,238,736 | A | 8/1993 | Tseng et al. |
| 5,310,595 | A | 5/1994 | Ali et al. |
| 5,372,987 | A | 12/1994 | Fisch et al. |
| 5,380,644 | A | 1/1995 | Yonkoski et al. |
| 5,475,418 | A | 12/1995 | Patel et al. |
| 5,811,371 | A | 9/1998 | Egashira et al. |
| 6,171,766 | B1 | 1/2001 | Patel et al. |

FOREIGN PATENT DOCUMENTS

| | | |
|---|---|---|
| EP | 0157568 | 10/1985 |
| EP | 0382420 | 8/1990 |
| EP | 0 583 940 | 2/1994 |
| EP | 0 587 148 | 3/1994 |
| EP | 0675003 | 10/1995 |

OTHER PUBLICATIONS

F. Rodriguez, Principles of Polymer Systems, 2d Edition, 1982, Section 2.5.

*Primary Examiner*—Bruce H. Hess
(74) *Attorney, Agent, or Firm*—Lynne M. Blank

(57) ABSTRACT

The present invention concerns a multi-layer thermal imaging receptor having superior transferability and image color stability for color proofing applications where the images are generated by a laser thermal process. The present invention includes a first support coated by at least, in order, a heat sensitive releasable transfer layer coated, an interfacial bonding layer and an image receiving layer of the present invention adapted to adhere to a second support when heated. The interfacial bonding layer is adapted to enhance adhesion between the heat sensitive releasable transfer layer and the image receiving layer. The present invention further provides a method of making a multi-layer thermal imaging receptor and a method of imaging using the receptor.

40 Claims, No Drawings

MULTI-LAYER LASER THERMAL IMAGE RECEPTOR SHEET WITH INTERNAL TIE LAYER

FIELD OF THE INVENTION

The invention relates generally to an image receptor sheet for color proofing and laser thermal imaging applications and a method of making and using the image receptor sheets. More particularly, the invention relates to an multi-layer image receptor sheet suitable for color imaging and laser thermal imaging processes having superior transferability and image color stability.

BACKGROUND OF THE INVENTION

There is an important commercial need to obtain a color proof that will accurately represent at least the details and color tone scale of the image before a printing press run is made. In many cases, it is also desirable that the color proof accurately represents the image quality and halftone pattern of the prints obtained on the printing press. In the sequence of operations necessary to produce an ink-printed, full-color picture, a proof is also required to check the accuracy of the color separation data from which the final three or more printing plates or cylinders are made.

The generation of a proof involves imagewise transfer of material using infrared radiation from a donor to a receptor where the material can include, for example, colorants, pigments, dyes, and specialty pigments such as metallics. The transferred material can form an image, on the receptor, which can then be transferred to another surface. The color stability and transferability of the transferred material, or proof, has been limited, however, by the receptors currently available.

For example, known receptors contain a color bleaching agent for reduction of residual color from infrared dye (IR dye) used in the donor sheets. In one such receptor, the bleaching agent is combined with a binder material such as styrene butadiene in a single layer on a substrate material. While this receptor construction bleaches residual color from IR dye, the use of styrene butadiene for the single layer construction is problematic in at least two respects. First, the diphenyl guanidine bleaching agent has a tendency to crystallize in styrene butadiene. Second, styrene butadiene provides good bonding to the receptor support making it difficult to pull the styrene butadiene completely away from the support. This results in limited transferability following lamination, especially to thin paper stocks.

As an alternative to the styrene butadiene and diphenyl guanidine combination, a single layer of a binder such as polyvinyl butyral combined with a bleaching agent such as diphenyl guanidine has been used to provide a receptor having improved transferability. While polyvinyl butyral provides good release and transfer from the receptor support to a second support, however, complete bleaching of residual IR dye is not achieved until several days later. As a result, small color shifts are observed in a final proof. It is possible to condition the final proof such as by heating the final proof at 95° C. for 3 minutes, but this step increases both processing time and expense of the final proof.

A two-layer receptor construction has been proposed that includes a layer of styrene butadiene and a layer of polyvinyl butyral. This two-layer receptor construction has been problematic, however, because of insufficient bonding between the two layers.

Therefore, there exists a need for a thermal imaging receptor that provides both improved transferability and image color stability.

SUMMARY OF THE INVENTION

In one embodiment of the present invention there is provided a multi-layer thermal imaging receptor having a first support coated with a heat sensitive releasable transfer layer coated on the first support, an interfacial bonding layer coated on the heat sensitive releasable transfer layer and an image receiving layer coated on the interfacial bonding layer. The image receiving layer of the present invention is adapted to adhere to a second support when heated. Further, the interfacial bonding layer is adapted to enhance adhesion between the heat sensitive releasable transfer layer and the image receiving layer.

In another embodiment of the present invention is a multi-layer thermal imaging receptor having a first support coated with, in order, a heat sensitive releasable transfer layer, an interfacial bonding layer and an image receiving layer. The heat sensitive releasable transfer layer includes polyvinyl butyral, a bleaching agent and a texturizing material. The interfacial bonding layer is coated on top of the heat sensitive releasable layer and includes a maleic anhydride modified ethylene copolymer. The interfacial bonding layer is adapted to enhance adhesion between the heat sensitive releasable transfer layer and the image receiving layer. Coated on the interfacial bonding layer is the image receiving layer. The image receiving layer includes styrene butadiene and a plasticizer and is adapted to adhere to a second support when heated but remains non-tacky at ambient temperature conditions.

In yet another embodiment of the present invention is a method of imaging that includes providing a multi-layer thermal imaging receptor having a first support coated with a heat sensitive releasable transfer layer coated on the first support, an interfacial bonding layer coated on the heat sensitive releasable transfer layer and an image receiving layer coated on the interfacial bonding layer. The method further includes providing a donor element and assembling the multi-layer thermal imaging receptor in contact with the donor element. The assembly is then exposed to laser radiation, where the laser radiation is modulated with digitally stored image information to transfer portions of the donor layer to the image receiving layer of the multi-layer thermal imaging receptor. The donor element and the multi-layer thermal imaging receptor are then separated to reveal an image residing on the multi-layer thermal imaging receptor. Following this step, the multi-layer thermal imaging receptor is laminated to a second support. The image receiving layer adheres to the second support and the first support is peeled away from the heat sensitive releasable transfer layer. Thus, the image receiving layer and the image, as well as the interfacial bonding layer and heat sensitive releasable transfer layer, are transferred to the second support.

In still another embodiment of the present invention is provided a method of making a multi-layer thermal imaging receptor. The method includes the steps of providing a first support and coating a thin film extrusion coating of a heat sensitive releasable transfer layer from a solvent solution onto the substrate. A distinct interfacial bonding layer is then coated on top of the heat sensitive releasable transfer layer by a thin film extrusion coating from a solvent solution. This step is followed by the step of coating a thin film extrusion coating of a distinct image receiving layer from a solvent solution on top of the interfacial bonding layer.

DETAILED DESCRIPTION

The present invention solves the previously described problems by providing a multi-layer thermal imaging receptor having both superior transferability and image color stability for color proofing applications.

In one embodiment of the present invention is provided a multi-layer thermal imaging receptor having a heat sensitive releasable transfer layer including a binder such as polyvinyl butyral (available as BUTVAR B76 from Solutia, Inc., St. Louis, Mo.) coated on a first support, an interfacial bonding layer coated on the heat sensitive releasable transfer layer and an image receiving layer including a binder such as styrene butadiene (available as PLIOLITE S-5A from Goodyear, Akron, Ohio) coated on the interfacial bonding layer. The interfacial bonding layer is adapted to enhance adhesion between the heat sensitive releasable transfer layer and the image receiving layer and the image receiving layer is adapted to adhere to a second support when heated.

In one embodiment of the present invention, the receptor further includes a color bleaching agent located in the heat sensitive releasable transfer layer for reduction of residual color from infrared dye (IR dye) used in donor sheets. In a further embodiment of the present invention the interfacial bonding layer includes a maleic anhydride modified ethylene copolymer blend (available as FUSABOND A from DuPont, Wilmington, Del.) to enhance adhesion between the heat sensitive releasable transfer layer and the image receiving layer. Accordingly, the interfacial bonding layer of the present invention bonds the transfer layer and the image receiving layer together reducing interfacial adhesion failure. After all colors are imaged, the receptor is thermally laminated to a permanent base stock. Thus, the present invention has the advantage of providing a more color stable final proof while still allowing easy release from the a first support such as a polyester substrate and good transfer to a second support such as thin paper stocks.

Transfer Layer

The present invention includes a heat sensitive releasable transfer layer (transfer layer). This transfer layer can include a binder such as polyvinyl butyral, a bleaching agent such as diphenyl guanidine and a texturizing material such as poly methyl methacrylate (PMMA) beads.

The transfer layer of this embodiment is a thin film solvent extruded coating and is adapted to substantially release from a first support upon heating. The chemical and physical properties of the binder material used in the transfer layer should therefore be capable of releasing from a first substrate upon heating. The transfer layer also should be in the form of a tack-free coating, with sufficient cohesive strength and durability to resist damage by abrasion, peeling, flaking, dusting, etc., in the course of normal handling and storage. Thus, binders with glass transition temperatures higher than ambient temperatures are preferred. The binder should further be capable of dissolving or dispersing other components of the transfer layer and should themselves be soluble in typical coating solvents such as lower alcohols such as ethanol, ketones such as methyl ethyl ketone (MEK), ethers, hydrocarbons, or haloalkanes. In one embodiment of the present invention, the binder is soluble in MEK. A suitable binder of the present invention further has a solubility parameter from about 10 to about 13. Principles of Polymer Systems, F. Rodrigues, 1982.

The binder of the present invention may include hydroxy groups, which may be alcoholic groups, phenolic groups or mixtures thereof. In one embodiment of the present invention the hydroxy groups are alcohol groups. The requisite hydroxy groups may be incorporated by polymerization or copolymerization of hydroxy-functional monomers such as alkyl alcohol and hydroxyalkyl acrylates or methacrylates, or by chemical conversion of preformed polymers, such as by hydrolysis of polymers and copolymers of vinyl esters such as vinyl acetate. Polymers with a high degree of hydroxy functionality (also referred to as hydroxy functional polymers), such as poly(vinyl alcohol) and cellulose are suitable for use in the invention. Derivatives of these hydroxy functional polymers generally exhibit superior solubility and film-forming properties, and provided that at least a minor proportion of the hydroxy groups remain unreacted, they are also suitable for use in the invention.

In one embodiment of the present invention the hydroxylic polymer is a derivative of a hydroxy functional polymer and is the product formed by reacting poly(vinyl alcohol) with butyraldehyde; namely polyvinyl butyral. Commercial grades of polyvinyl butyral typically have at least 5% of the hydroxy groups unreacted (free) and are soluble in common organic solvents and have excellent film-forming and pigment-dispersing properties. One suitable polyvinyl butyral binder is available under the trade designation BUTVAR B-76 from Solutia, Inc., St. Louis, Mo. This binder includes from about 11 to 13% free hydroxyl groups, has a glass transition temperature of from about 62° C. to 72° C. and a flow temperature at 1000 psi of from about 110° C. to 115° C. Other hydroxylic binders from the BUTVAR series of polymers may be used in place of the BUTVAR B-76. These include, for example, other polyvinyl butyral binders available under the trade designations BUTVAR B-79 from Solutia, Inc. Still others are MOWITAL B30T from Hoechst Celanese, Chatham, N.J. The various products typically vary with respect to the amount of free hydroxyl groups. For example BUTVAR B-76 polyvinyl butyral includes less than about 13-mole % free hydroxy groups, whereas MOWITAL B30T polyvinyl butyral includes about 30% free hydroxy groups.

While the present invention has been described with specific reference to polyvinyl butyral for the binder of the transfer layer, alternative thermoplastic or vinyl binders can also be used provided they possess the chemical and physical properties compatible with the requirements previously described for the transfer layer.

In one embodiment of the present invention, the binder is present in an amount of about 70 wt-% to about 90 wt-% based on the total weight of the transfer layer. In one embodiment of the present invention the total weight of the transfer layer is from about 300 mg/ft$^2$ to about 700 mg/ft$^2$, or about 3.2 g/m$^2$ to about 7.5 g/m$^2$.

A problem common to many imaging systems is the fact that unless the cationic IR absorbing dye (IR dye) of a donor material is completely colorless, the final image is contaminated, not a true color reproduction and hence unacceptable for high quality proofing purposes. For example, if the IR dye is transferred to a receptor during imaging, it can visibly interfere with the color produced because it absorbs slightly in the visible region of the spectrum. Attempts have been made to find IR dyes with minimal visible absorption, as in, for example, EP 157 568 (ICI). In practice, however, there is nearly always some residual absorption, which interferes with the color stability of the final proof.

Therefore, a bleaching agent is included in the transfer layer of the present invention to remove unwanted visible absorbance so that a more accurate and predictable color may be achieved. The invention therefore provides a convenient and effective means of removing any unwanted coloration caused by the presence of the IR dye in an embodiment of the present invention.

Suitable bleaching agents of the present invention do not require exposure to light to become active, but will bleach the IR dyes at ambient or elevated temperatures. The term "bleaching" means a substantial reduction in absorption giving rise to color visible to the human eye, regardless of how this is achieved. For example, there may be an overall reduction in the intensity of the absorption, or it may be shifted to non-interfering wavelengths, or there may be a change in shape of the absorption band, such as, a narrowing, sufficient to render the IR dye colorless.

Suitable bleaching agents of the present invention include nucleophiles, such as an amine or a salt that decomposes thermally to release an amine, or a reducing agent, as described in EP 675 003 (3M). In one embodiment of the present invention, the bleaching agents are amines such as guanidine or salts thereof, wherein the guanidine bleaching agents have the following general formula (I):

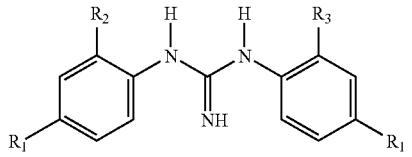

where each $R^1$ and $R^2$ is independently hydrogen or an organic moiety or hydrogen or an alkyl moiety, such as a $C_1$–$C_4$ alkyl moiety. Such diphenyl guanidines are commercially available from Aldrich Chemical Company, Milwaukee, Wis., or can be synthesized by reaction of cyanogen bromide with the appropriate aniline derivatives.

Guanidines have good stability, solubility, and compatibility with the transfer layer binders disclosed herein. They are solids as opposed to liquids, and are rapid acting. Solids are advantageous because they are involatile at room temperature. They are relatively small molecules that diffuse very effectively into adjacent materials when heated. Significantly, they do not discolor during storage, do not precipitate out of solvent-based systems prior to coating onto a substrate. In one embodiment of the present invention, the bleaching agent of the present invention is soluble in MEK.

Another bleaching agent suitable for use in the practice of the present invention is 1-(o-tolyl)biguanide, which is represented by the following structure:

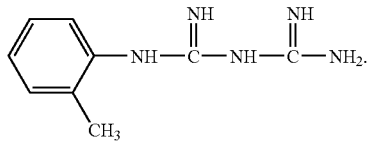

1-(o-tolyl)biguanide is available commercially from Sigma-Aldrich Corp., St. Louis, Mo.; product number 42,466–8). 1-(o-tolyl)biguanide can also be readily synthesized using conventional methods. The compound is solid at room temperature. 1-(o-tolyl)biguanide has good stability, solubility, and compatibility with the binders disclosed herein.

1-(o-tolyl)biguanide acts as a thermal bleaching agent towards certain IR dyes (such as tetraarylpolymethine dyes) which are frequently used as photothermal converters in media for thermal transfer imaging. 1-(o-tolyl)biguanide is also a fast-acting bleaching agent.

An alternative class of bleaching agent capable of bleaching the cationic IR absorbing dyes includes the 1,4-dihydropyridines of formula (II-a):

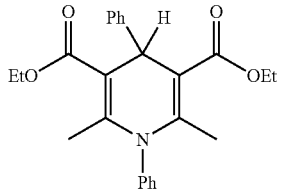

where $R^4$ is hydrogen or an alkyl moiety, such as an alkyl moiety having up to 5 carbon atoms. Such dihydropyridines can be prepared by known methods, such as by an adaptation of the Hantsch pyridine synthesis. Alternative thermal bleaching agents of this type include:

Formula (II-b)

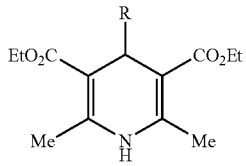

(where R is hydrogen or a $C_1$–$C_4$ alkyl moiety)

Formula (II-c)

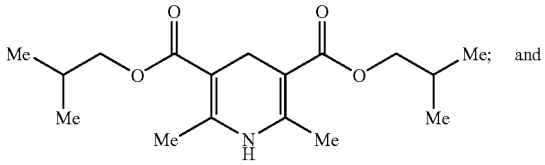

Formula (II-d)

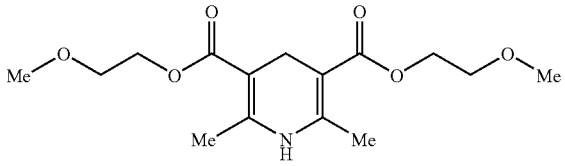

Such compounds bleach TAPM dyes of formula (III):

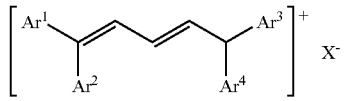

wherein each $Ar^1$, $Ar^2$, $Ar^3$ and $Ar^4$ is aryl and at least one (and more preferably at least two) aryl has a cationic amino substituent (preferably in the 4-position), and X is an anion. Preferably no more than three (and more preferably no more than two) of said aryl bear a tertiary amino group. The aryl bearing said tertiary amino groups are preferably attached to different ends of the polymethine chain ($Ar^1$ or $Ar^2$ and $Ar^3$ or $Ar^4$ have tertiary amino groups). The bleaching is believed to occur via a redox reaction.

The amount of bleaching agent employed may vary considerably. The required quantity will depend on the quantity and characteristics of the IR dye, such as its propensity to co-transfer with a colorant during imaging, the intensity of its visible coloration, etc. In one embodiment of the present invention, the bleaching agent may be present from about 2 wt.-% to about 22 wt.-% of the transfer layer, where the transfer layer has a coverage amount of from about 300 to about 700 mg/ft$^2$ or about 3.2 to about 7.5 g/m$^2$.

The transfer layer of the present invention can further include particulate material or otherwise be engineered so as to present a surface having a controlled degree of roughness. That is, the receptor of the present invention includes a support bearing a plurality of protrusions that project above the outer surface of the receptor substrate. The protrusions may be created by incorporating polymer beads or silica particles, for instance, in a binder to form a receiving layer, as disclosed, for example, in U.S. Pat. No. 4,876,235 (DeBoer). Microreplication may also be used to create the protrusions, as disclosed in EP 382 420 (3M).

When one (or both) of a donor or receptor sheet presents a roughened surface, vacuum draw-down of the one to the other is facilitated. Although the use of particulate material in color proof systems is known, as is disclosed in U.S. Pat. No. 4,885,225 (Heller, et al.), for example, it has been discovered that the protrusions on the receptor significantly enhance transfer of a donor layer to the image receiving layer of the receptor and thereby the image quality. Without such protrusions in (or on) the receptor surface, there can be a tendency for dust artifacts and mottle to result in small areas (approximately 1 mm) of no image transfer.

The protrusions in the receptor regulate precisely the relationship between the donor and the receptor. That is, the protrusions are believed to provide channels for air that would otherwise be trapped between the donor and receptor to escape so there is uniform contact between the donor and the receptor over the entire area, which is otherwise impossible to achieve for large images. More importantly, the protrusions are believed to prevent entrapment of air in the transferred imaged areas. As the molten or softened film transfers to the receptor in a given area the air can escape through the channels formed by the protrusions. The protrusions should provide a generally uniform gap between the donor and the receptor, which is important for effective film transfer.

In one embodiment of the present invention, the protrusions are formed from inert particulate material, such as polymeric beads. The beads or other particles may be of essentially uniform size (a monodisperse population) or may vary in size (a polydisperse population). Dispersions of inorganic particles such as silica generally have a range of particle sizes. The particles should not project above the surface of the receptor substrate by more than about 8 μm on average, but should project above the surface of the receptor substrate by at least about 1 μm, or alternatively by at least about 3 μm. The composition of the polymeric beads is generally chosen such that substantially all of the visible wavelengths (400 nm to 700 nm) are transmitted through the material to provide optical transparency. Nonlimiting examples of polymeric beads that have excellent optical transparency include polymethyl methacrylate and polystearyl methacrylate beads, described in U.S. Pat. No. 2,701,245 (Lynn) and beads comprising diol dimethacrylate homopolymers or copolymers of these diol dimethacrylates with long chain fatty alcohol esters of methacrylic acid and/or ethylenically unsaturated comonomers, such as stearyl methacrylate/hexanediol diacrylate crosslinked beads, as described in U.S. Pat. No. 5,238,736 (Tseng, et al.) and U.S. Pat. No. 5,310,595 (Ali, et al.).

The shape, surface characteristics, concentration, size, and size distribution of the polymeric beads are selected to optimize performance of the transfer process. The smoothness of the bead surface and shape of the bead may be chosen such that the amount of reflected visible wavelength (400 nm to 700 nm) of light is kept to a minimum. This may or may not be an issue depending upon the actual substrate used. For example, if the color proof is formed on a transparent substrate, the haze introduced by the presence of the beads may effect the color of the proof. The shape of the beads can be spherical, oblong, ovoid, or elliptical. In some constructions, it is advantageous to add two distinct sets of beads with different average sizes. This allows the flexibility to balance haze with slip or separation characteristics.

The optimum particle size depends on a number of factors, including the thickness of the receptor, the thickness of the receptor element, and the number of layers to be transferred to a given receptor from a donor. In the case of transfer of two or more donor layers to a receptor, the projections provided by the particles must be great enough not to be obscured by the first layer(s) transferred thereto. If the average projection is significantly greater than about 8 μm, however, transfer of the transfer material as a coherent film becomes generally impossible, and the quality of the transferred image deteriorates markedly. In the case of polydisperse populations of particles, such as silica particles, excellent results have been obtained when the largest of said particles project above the surface of the receptor substrate by about 4 μm. In one embodiment of the present invention 12.5 micrometer polymethyl methacrylate beads are included in the image receiving layer.

The transfer layer of the present invention can further include optional additives such as coating aids, optical brighteners, UV absorbers, fillers, plasticizers, matte agents and release agents provided they do not interfere with the functional characteristics of the binder and bleaching agent. For example, surfactants may be used to improve solution stability. A wide variety of surfactants can be used. One surfactant is a fluorocarbon surfactant used to improve coating quality. Suitable fluorocarbon surfactants include fluorinated polymers, such as the fluorinated polymers described in U.S. Pat. No. 5,380,644 (Yonkowski, et al.), which is incorporated herein by reference.

Image Receiving Layer

In one embodiment of the present invention is additionally provided an image receiving layer. The image receiving layer of the present invention includes at least a binder such as styrene butadiene. The image receiving layer can further include a plasticizer and/or polymethyl methacrylate beads such as those included in the transfer layer.

The image receiving layer of this embodiment is a thin film, solvent extruded coating and is adapted to adhere to a second support when heated. The binder of the image receiving layer of the present invention should be adapted to be color stable. Additionally, the chemical and physical properties of the binder should be such that the image receiving layer is in the form of a smooth, tack-free coating, with sufficient strength and durability to resist damage by abrasion, peeling, flaking, dusting, etc., in the course of normal handling and storage at ambient conditions yet still exhibit adhesive properties upon heating. Thus, a suitable binder for the image receiving layer is a thermoplastic adhesive having a glass transition temperature higher than ambient temperature. In one embodiment of the present invention, the binder for the image receiving layer has a glass transition temperature lower than the glass transition temperature of the binder of the transfer layer. The binder of the image receiving layer of an embodiment of the invention should also be capable of dissolving or dispersing other components of the image receiving layer, and should itself be soluble in solvents such as toluene, methyl isobutyl ketone, cyclohexanone and mixtures thereof. In one embodiment of the present invention the solvent is toluene. A suitable binder of the image receiving layer further has a solubility parameter of about 8. Principles of Polymer Systems, F. Rodrigues, 1982.

In one embodiment of the present invention, the binder of the image receiving layer is a styrene-butadiene copolymer available under the trade designation PLIOLITE S5C. Alternative binders such as latex and water based emulsions, acrylic emulsions, urethanes and mixtures thereof may be used in the image receiving layer of the present invention provided they possess the chemical and physical properties previously described.

Coating aids, optical brighteners, UV absorbers, plasticizers and fillers, for example, can also be incorporated into the image receiving layer. In one embodiment of the present invention, a plasticizer is included to increase flexibility of the image receiving layer. Suitable plasticizers for use in the present invention include SANTICIZER 160, SANTICIZER 148 and SANTICIZER 278 from Solutia Co., St. Louis, Mo. and DOTP (or dioctyl terephthalate) from Eastman Chemical, Kingsport, Tenn.

Surfactants can also be used to improve solution stability. A wide variety of surfactants can be used. One surfactant is a fluorocarbon surfactant used to improve coating quality. Suitable fluorocarbon surfactants include fluorinated polymers, such as the fluorinated polymers described in U.S. Pat. No. 5,380,644 (Yonkoski, et al.), which was previously incorporated by reference.

Interfacial Bonding Layer

In one embodiment of the present invention is further provided an interfacial bonding layer. The interfacial bonding layer is a thin film, solvent extruded coating. In one embodiment of the present invention, the interfacial bonding layer is soluble in and coated from toluene or a solvent blend of toluene and MEK.

The interfacial bonding layer of the present invention is located between the transfer layer and the image receiving layer and is adapted to enhance adhesion between these two respective layers. Absent the interfacial bonding layer, adhesion between the transfer layer and image receiving layer of the present invention is limited. This can be explained, in part, by reviewing the solubility parameters of the binders used for the two layers. In one embodiment of the present invention the transfer layer includes polyvinyl butyral, which has a solubility parameter of from about 10 to about 13 whereas the image receiving layer includes styrene butadiene, which has a solubility parameter of about 8. The differences in the solubility parameters are such that the two materials have low compatibility interactions.

Therefore, in one embodiment of the present invention is provided an interfacial bonding layer, which includes at least a maleic anhydride modified ethylene copolymer (maleic anhydride graft polymer). The maleic anhydride graft polymer of the present invention reacts with both the transfer layer and the image receiving layer to enhance adhesion. In particular, the anhydride (or hydrophilic) moieties of the maleic anhydride graft polymer react with hydroxyl moieties of the transfer layer binder. At the same time, the binder of the image receiving layer is compatible with the hydrophobic polymer backbone of the maleic anhydride graft polymer.

Maleic anhydride graft polymers are available for example as FUSABOND A from DuPont, Wilmington, Del. or PLEXAR from Eqiustar, Houston, Tex. Materials other than the maleic anhydride modified ethylene copolymer can also be used in the present invention provided the chemical and physical characteristics functional adhesion characteristics are maintained. Example of suitable materials include a polyamide available as ULTRAMID from BASF located in Ludwigshafen, Germany or AMILAN from Toray located in Tokyo, Japan, and polyethylenimine (PEI) from Aldrich Chemical, Milwaukee, Wis. Alternative materials as well as combinations of the materials just described can be included in the interfacial bonding layer provided the physical and chemical bonding properties between the thermal layer and image receiving layer are retained.

The interfacial bonding layer of the present invention is not intended to act as a barrier layer between the transfer layer and image receiving layer. In fact, in one embodiment of the present invention, the interfacial bonding layer is adapted to permit migration of the bleaching agent from the transfer layer towards and/or into the image receiving layer upon heating of the receptor. In this embodiment, the bleaching agent migrates from the transfer layer to image receiving layer during heating so that the bleaching agent can mix with the IR dye that contacts the image receiving layer. The mechanism by which this occurs includes heating the receptor to or greater than the glass transition temperature of the receiving layer binder and the transfer layer binder such that the bleaching agent can migrate. The bleaching agent is located within the transfer layer prior to heating to prevent crystallization of the bleaching agent in the image receiving layer.

The interfacial bonding layer can optionally include coating aids, optical brighteners, UV absorbers, and fillers, for example, provided the physical and chemical bonding properties between the thermal layer and image receiving layer are retained.

First Support

The receptor of the present invention includes a support or substrate on which is coated the transfer layer followed next by the interfacial bonding layer and then the image receiving layer.

The first support material is generally chosen based on the particular application. The first support can be transparent or opaque. Nontransparent receptor sheets can be diffusely reflecting or specularly reflecting. Suitable first support materials include coated paper, metals such as steel and aluminum; glass, polymeric films or plates composed of various film-forming synthetic or high polymers including addition polymers such as poly(vinylidene chloride), poly (vinyl chloride), poly(vinyl acetate), polystyrene, polyisobutylene polymers and copolymers, and linear condensation polymers such as poly(ethylene terephthalate), poly(hexamethylene adipate), and poly(hexamethylene adipamide/adipate) and mixtures thereof. In one embodiment of the present invention, the first support consists of a polyester film. For color imaging, the first support can include coated paper or a plastic film.

Second Support

Following the imaging process, the image residing on the receptor material, as well as the layers of the receptor can be laminated to a second support.

Similar to the first support of the present invention, the second support is generally chosen based on the particular application. The second support can be transparent or opaque. Nontransparent receptor sheets can be diffusely reflecting or specularly reflecting. Suitable second support materials include thin paper, paper (plain or coated), metals such as steel and aluminum, glass, polymeric films or plates composed of various film-forming synthetic or high polymers including addition polymers such as poly(vinylidene chloride), poly(vinyl chloride), poly(vinyl acetate), polystyrene, polyisobutylene polymers and copolymers, and linear condensation polymers such as poly(ethylene terephthalate), poly(hexamethylene adipate), and poly(hexamethylene adipamide/adipate) and mixtures thereof. In one embodiment of the present invention, the second support is thin paper. In one embodiment of the present invention, the second support is thin paper having a thickness of from about 2 to about 20 mil, or from about 51 to about 508 μm. For color imaging, the second support can include paper (plain or coated) or a plastic film.

Preparation of the Receptor

The present invention additionally provides a method of making a multi-layer thermal imaging receptor. The thermal transfer, interfacial and image receiving layers of the receptor of the present invention can be prepared by dissolving or dispersing the various components of each layer in a suitable solvent and coating each layer by thin film extrusion. In one embodiment, a mixture of solvents can be used for the individual layers, which assists in controlling the drying rate and avoiding formation of cloudy films.

Thus, for example, the method includes the steps of coating a thin film extrusion coating of a heat sensitive releasable transfer layer (transfer layer) from a solvent solution onto a first support. In one embodiment of the present invention, the transfer layer is solvent extruded from MEK. Following this step, a distinct interfacial bonding layer is thin film extruded from a solvent solution on top of the transfer layer. The interfacial bonding layer of an embodiment of the present invention is solvent extruded from toluene. Alternatively, the interfacial bonding layer can be solvent extruded from a solvent blend of toluene and MEK. Next, the image receiving layer is solvent extruded on top of the interfacial bonding layer. The image receiving layer of the present invention can be solvent extruded from a solvent blend of toluene and MEK. Alternatively, the image receiving layer can be solvent extruded out of toluene. The method of making a multi-layer thermal imaging receptor can further include the step of drying the multi-layer thermal imaging receptor in drying ovens at about 100° C. (212° F.) for a time period of from about 1 to about 3 minutes. The drying process can facilitate removal of the solvent portion of the coating.

The relative proportions of the components of each layer of the receptor element may vary widely, depending on the particular choice of ingredients and the type of imaging required.

In one embodiment of the present invention the transfer layer is obtained by coating the following formulation from MEK to provide a dry coating amount of about 550 mg/ft$^2$:

Transfer Layer

| | |
|---|---|
| polyvinyl butyral (e.g. BUTVAR B76A) | from about 4.95 to about 20 wt % |
| bleaching agent (e.g. diphenylguanidine) | from about 2 to about 22 wt % |
| polymethyl methacrylate beads | from about 0.05 to about 3.0 wt % |
| MEK | from about 55 to about 95 wt % |

Similarly, the interfacial bonding layer can be obtained by coating the following formulation from a mixture of MEK and toluene to provide a dry coating amount of from about 25 to about 35 mg/ft$^2$:

Interfacial Bonding Layer

| | |
|---|---|
| FUSABOND A (e.g. maleic anhydride modified ethylene copolymer) | from about 2 to about 5 wt % |
| toluene | from about 45 to about 49 wt % |
| MEK | from about 45 to about 49 wt % |

In another embodiment of the present invention the interfacial bonding layer is obtained by coating the following formulation from toluene to provide a dry coating amount of from about 25 to about 35 mg/ft$^2$:

Interfacial Bonding Layer

| | |
|---|---|
| FUSABOND A (e.g. maleic anhydride modified ethylene copolymer) | from about 2 to about 5 wt % |
| toluene | from about 95 to about 98 wt % |

And finally, the image receiving layer is obtained by coating the following formulation from toluene to provide a dry coating amount of about 200 mg/ft$^2$:

Image Receiving Layer

| | |
|---|---|
| styrene butadiene (e.g. PLIOLITE S5A) | from about 4.95 to about 38 wt % |
| plasticizer | from about 0.05 to about 10 wt % |
| MEK | from about 26 to about 47.5 wt % |
| toluene | from about 26 to about 47.5 wt % |

Alternatively, toluene can be used for the image receiving layer.

Imaging with the Receptor

The present invention moreover provides a method of imaging that involves imagewise transfer of material from a donor to a receptor. In one embodiment, the method of imaging includes providing a multi-thermal imaging receptor (receptor) that includes a first support coated, in order, with at least a heat sensitive releasable transfer layer (transfer layer), an interfacial bonding layer and an image receiving layer where the interfacial bonding layer is adapted to enhance adhesion between the transfer layer and the image receiving layer and the image receiving layer is also adapted to adhere to a second support when heated.

The procedure for imagewise transfer of material from the donor to the receptor of the present invention further involves assembling the donor and the image receiving layer of the receptor in intimate face-to-face contact, such as by vacuum hold down or alternatively by means of the cylindrical lens apparatus described in U.S. Pat. No. 5,475,418 (Patel, et al.), which is incorporated herein by reference, and scanned by a suitable laser. The assembly may be imaged by any of the commonly used lasers, depending on the cationic IR absorbing dye used. In one embodiment of the present invention, exposure to laser radiation by near IR and IR emitting lasers such as diode lasers and YAG lasers, is employed.

Any of the known scanning devices may be used, such as flat-bed scanners, external drum scanners, or internal drum scanners. In these devices, the assembly to be imaged is secured to the drum or bed such as by vacuum hold-down, and the laser beam is focused to a spot of about 20 μm diameter for instance, on the donor-receptor assembly. This spot is scanned over the entire area to be imaged while the laser output is modulated in accordance with electronically stored image information. Two or more lasers may scan different areas of the donor receptor assembly simultaneously, and if necessary, the output of two or more lasers may be combined optically into a single spot of higher intensity. Exposure to laser radiation is normally from the donor side, but may be from the receptor side if the receptor is transparent to the laser radiation.

In one embodiment of the present invention the imaging unit is the CREO SCITEX TRENDSETTER imager available commercially as the CREO TRENDSETTER SPECTRUM. The imaging conditions used are machine set points selected to best expose the donor. Drum speed is defined as the revolutions per minute (RPM) the donor is rotated in front of the laser thermal head. The Wpower is defined as the total watts of imaging power from the laser thermal head. SR stands for surface reflectivity and is measured by the laser thermal head focusing mechanism. This value is donor dependent and is used to obtain best focusing performance. SD stands for surface depth and is set to obtain the best performance of the focusing mechanism. It is also donor dependent. The methods to do these measurements are described in published Creo instruction manuals and technical literature. The machine stores these values and automatically selects them based on what color donor is to be imaged.

Following this step, the donor is separated from the receptor. Peeling apart the donor and receptor reveals a monochrome image on the receptor. The process may be repeated one or more times using donor sheets of different colors to build a multicolor image on a common receptor. Because of the interaction of the IR dye and the bleaching agent during exposure to laser radiation, the final image can be free from contamination by the IR dye. In one embodiment of the present invention, a subsequent heat treatment can be used to activate or accelerate the bleach chemistry.

After peeling the donor sheet from the receptor, the image residing on the receptor can be cured by subjecting it to heat treatment where the temperatures are in excess of about 120° C. This may be carried out by a variety of means, such as by storage in an oven, hot air treatment, contact with a heated plate or passage through a heated roller device. In the case of multicolor imaging, where two or more monochrome images are transferred to a common receptor, it is more convenient to delay the curing step until all the separate colorant transfer steps have been completed, then provide a single heat treatment for the composite image. However, if the individual transferred images are particularly soft or easily damaged in their uncured state, then it may be necessary to cure and harden each monochrome image prior to transfer of the next.

The method of the present invention can further include the step of transferring the image residing on the image receiving layer of the receptor and the layers of the receptor to a second support. This transfer can be accomplished by first assembling the image receiving layer of the receptor and a second support in intimate face-to-face contact. This assembly is then heated to a temperature to at least the glass transition temperature of the transfer layer and at least as great as the glass transition temperature of the image receiving layer so that the adhesive characteristics of the image receiving layer are promoted. The first support is then peeled away from the transfer layer. In yet another embodiment of the present invention, the assembly is subjected to an amount of pressure suitable to induce adhesion of the image receiving layer to a second support.

Further objects and advantages of the invention will become apparent from a consideration of the examples and ensuing description, which illustrate embodiments of the invention. While the invention is susceptible to various modifications and alternative forms, specific embodiments have been described and exemplified in detail. It should be understood, however, that the description of specific embodiments is not intended to limit the invention to the particular forms disclosed, but rather, the intention is to cover all modifications, equivalents, and alternatives falling within the spirit and scope of the invention as defined by the claims. References cited throughout this application are also incorporated by reference.

EXAMPLES

The following materials are used in the Examples:

| | |
|---|---|
| Binder Material: | BUTVAR B-76 (polyvinylbutyral resin with free OH content of from about 11 to 13 mole %) available from Solutia, Inc<br>PLIOLITE 5-S (styrene butadiene) available from Goodyear, Akron, OH |
| Bleaching Agent: | Diphenyl guanidine bleaching agent available from Aldrich Chemical Company, Milwaukee, WI |
| Plasticizer: | PEI (polyethyleneimine) available from Aldrich Chemical Company |
| Texturizer: | (PMMA) Polymethyl methacrylate beads available from 3M, St. Paul, MN |
| Optional Ingredients: | SAA-100 (styrene allyl alcohol to enhance adhesion) from Lyondell Chemical Company, Houston, TX |
| Solvent: | MEK (methyl ethyl ketone) available from Aldrich Chemical Company<br>Toluene available from Aldrich Chemical Company |

-continued

| | |
|---|---|
| First Support: | PET (polyethyleneterephthalate film) available from DuPont, Wilmington, DE<br>574 Polyester film available from DuPont |
| Second Support: | 20# Text Web Paper (#5 Ground Wood Paper) available from Champion Paper Company, Stamford, CT<br>MATCHPRINT Digital Halftone Commercial Base (Commercial Base) available from Kodak Polychrome Graphics, Norwalk, CT |
| Control Receptor: | RELEASE RECEPTOR II, available from Kodak Polychrome Graphics<br>GT Receptor available from Kodak Polychrome Graphics |
| Laminator: | 447L laminator available from Kodak Polychrome Graphics |
| Spectrophotometer: | Gretag SPM 100 available from Gretag Ltd., Regensdorf, Switzerland |

The following formulations were used to prepare a heat sensitive transfer layer, an interfacial bonding layer and an image receiving layer of the present invention.

Formula A. Heat Sensitive Releasable Transfer Layer

| Materials | Weight (g) | % Solids |
|---|---|---|
| BUTVAR B76 (in solution of MEK) | 87.15 | 10.0 |
| diphenylguanidine | 1.95 | 100.0 |
| MEK | 7.16 | 0.0 |
| SAA-100 | 2.18 | 100.0 |
| 10.5 μm PMMA beads | 1.56 | 10.0 |
| Total | 100.00 | 13.0 |

Formula B. Interfacial Bonding Layer

| Materials | Weight (g) | % Solids |
|---|---|---|
| FUSABOND A | 2.50 | 100.0 |
| MEK | 48.75 | 0.0 |
| Toluene | 48.75 | 0.0 |
| Total | 100.0 | 2.5 |

Formula C1. Image Receiving Layer with PEI

| Materials | Weight (g) | % Solids |
|---|---|---|
| PLIOLITE S-5A | 39.33 | 20.0 |
| PEI 10%/MEK | 1.33 | 10.0 |
| MEK | 36.34 | |
| Toluene | 23.00 | |
| Total | 100.00 | 8.0 |

Formula C2. Image Receiving Layer without PEI

| Materials | Weight (g) | % Solids |
|---|---|---|
| PLIOLITE S-5A | 39.86 | 20.0 |
| MEK | 36.83 | 0.0 |

-continued

| Materials | Weight (g) | % Solids |
|---|---|---|
| Toluene | 23.31 | 0.0 |
| Total | 100.00 | 8.00 |

The formulations A, B, C1 and C2 were then used to create the following receptor variables.

| Variable | Transfer Layer Formula | Transfer Layer Coating amount (mg/ft$^2$) | Interfacial Bonding Layer Formula | Interfacial Bonding Layer Coating amount (mg/ft$^2$) | Image Receiving Layer Formula | Image Receiving Layer Coating amount (mg/ft$^2$) |
|---|---|---|---|---|---|---|
| 1 | A | 550 | B | 35 | C2 | 200 |
| 2 | A | 550 | B | 30 | C2 | 200 |
| 3 | A | 550 | B | 25 | C2 | 200 |
| 4 | A | 550 | — | — | C2 | 200 |
| 5 | A | 550 | B | 25 | C1 | 200 |
| 6 | A | 550 | B | 30 | C1 | 200 |
| 7 | A | 550 | B | 35 | C1 | 200 |
| 8 | A | 550 | — | — | C1 | 200 |
| 9 | A | 550 | — | — | — | — |

Receptor Variables 1–8 were coated onto 574 polyester as a thin film solvent extruded coating. The transfer layer was coated first using a #38 meyer bar and dried in a drying oven for 3 minutes at 95° C. (203° F.). The interfacial bonding layer was then coated on top of the transfer layer using a #3, #4, and #5 meyer bar for the respective coating amounts of 25, 30 and 35 mg/ft$^2$ and dried in a drying oven for 2 minutes at 95° C. (203° F.). Following this step, the image receiving layer was coated on top of the interfacial bonding layer using a #18 meyer bar and dried in a drying oven for 3 minutes at 95° C. (203° F.).

Samples of Receptor Variables 1–8 were then imaged with a CREO TRENDSETTER unit with the following conditions:

| | Cyan Donor | Yellow Donor |
|---|---|---|
| Drum Speed | 160 | 170 |
| Wpower | 16.7 | 15.7 |
| SR | 80 | 65 |
| SD | 0.42 | 0.44 |

Tape pull adhesion tests were conducted with the receptor variables. The tape pull adhesion test provided information regarding the adhesion quality between the transfer layer and the image receiving layer.

Samples of each of the receptor variables, both imaged and non-imaged, were laminated to Matchprint Digital Halftone Commercial Base (Commercial Base). After lamination to the Commercial Base, the 574 polyester film was peeled from the receptor layers of each variable. The laminated receptor variables were then scored with a 1 mm steel rod in a cross-hatch pattern. Following this step, a layer of tape was adhered to the surface of the image receiving transfer layer. The tape was then pulled in the opposite direction from the laminated receptor variable in a quick motion. The results of the tape pull adhesion test were evaluated in Kral units (KU), where a numerical value 0 denotes very good adhesion and a numerical value of 6 denotes poor adhesion.

Table 1 provides results of the tape pull adhesion tests conducted on receptors that were imaged and laminated to Commercial Base. Table 2 provides results of the tape pull adhesion tests conducted on non-imaged receptors that were laminated to Commercial Base.

TABLE 1

| Imaged | | | |
|---|---|---|---|
| Variable | Trial 1 | Trial 2 | Average |
| 2 | 1 | 1 | 1 |
| 4 | 6 | 6 | 6 |
| 6 | 0 | 0 | 0 |
| 8 | 3 | 3 | 3 |
| 9 | 1 | 1 | 1 |

TABLE 2

| Non-imaged | | | | |
|---|---|---|---|---|
| Variable | Trial 1 | Trial 2 | Trial 3 | Average |
| 1 | 2 | 3 | 2 | 2.3 |
| 2 | 5 | 4 | 3 | 4.0 |
| 3 | 3 | 2 | 3 | 2.7 |
| 4 | 6 | 6 | 3 | 5.0 |
| 5 | 3 | 2 | 3 | 2.7 |
| 6 | 4 | 4 | 3 | 3.7 |
| 7 | 5 | 3 | 3 | 3.7 |
| 8 | 4 | 5 | 5 | 4.7 |
| 9 | 2 | 2 | 1 | 1.7 |

Blocking tests were also conducted with the receptor variables to test the ability of the receptor sheets to remain separate in a stacked configuration under storage conditions involving heat and pressure. Additional data collected as part of the blocking test was observation of diphenylguanidine (DPG) blooming. Blooming is the undesirable migration of DPG to the receptor surface and crystallization of the DPG either at the surface of the image receiving layer or on the backside of an adjacent sheet in the stacked configuration.

Several receptor variables were configured into stacks. To provide heat and pressure to the samples, the stacks were placed in a 60° C. over for three days covered with three glass plates, which exerted a pressure of 0.58 gms/cm$^2$. After three days, the receptor variables were removed from the oven, allowed to cool and evaluated for blocking and blooming. The results of the blocking test were evaluated in Kral units (KU), where a numerical value 0 denotes easy separation from an adjacent sheet (no blocking) and a numerical value of 6 denotes complete bonding of the receptor variable to the adjacent sheet (severe blocking). The results of the DPG blooming test were evaluated by observing the size of the crystals and the amount of surface area covered by crystals. A condition of no DPG blooming is preferred. The following designations were used to indicate the observations:

NO=no blooming observed;

SLIGHT=small crystals of DPG covering small areas;

MODERATE=large crystals covering large areas; and

SEVERE=large crystals covering the entire surface.

Table 3 provides results of the blocking and DPG blooming tests.

TABLE 3

| Blocking Test | | | | | | |
|---|---|---|---|---|---|---|
| Variable | Trial 1 | Trial 2 | Trial 3 | Trial 4 | Average | DPG Blooming |
| 1 | 0.5 | 0.5 | 0.5 | 0.5 | 0.5 | NO |
| 2 | 0.5 | 0.5 | 0.5 | 0.5 | 0.5 | SLIGHT |
| 3 | 1 | 0.5 | 0.5 | 0.5 | 0.6 | NO |
| 4 | 0.5 | 0.5 | 0.5 | 1.0 | 0.6 | NO |
| 5 | 0.5 | 0.5 | 0.5 | 0.5 | 0.5 | SLIGHT |
| 6 | 0.5 | 0.5 | 0.5 | 1.0 | 0.6 | SLIGHT |
| 7 | 0.5 | 0.5 | 0.5 | 1.0 | 0.6 | SLIGHT |
| 8 | 0.5 | 0.5 | 0.5 | 0.5 | 0.5 | NO |
| 9 | 0 | 0.5 | 0 | 0.5 | 0.3 | NO |

The receptor variables were further subjected to a 20# text web test. The text web test provided information about the releasability of the 574 film (first support) from the transfer layer. If the releasability from the 574 film is poor (high peel force and/or uneven peel force) the thin, fragile 20# text web stock will be damaged either by internal failure of the paper core or tearing of the paper stock.

The receptor variables were laminated to 20# Text Web and allowed to cool the 574 film (first support) was then quickly removed by hand at peel angle of about 120 degrees. After peeling, the 20# Text Web was evaluated for damage. A control sample involving a receptor construction known to have higher peel force was included for comparison.

The results of this test are provided in Table 4.

TABLE 4

| 20# Text Web Test with Paper | | |
|---|---|---|
| Variable | Peel Force | Paper Damage |
| 1 | Moderate | No |
| 2 | Moderate | No |
| 3 | Moderate | No |
| 4 | Moderate | No |
| 5 | Easy | No |
| 6 | Easy | No |
| 7 | Easy | No |
| 8 | Easy | No |
| 9 | Easy | No |
| Release Receptor II (control) | Hard and Uneven | YES |

To evaluate the color stability of the present invention, two samples were used. A GT receptor was used as a control variable to represent the situation of a single layer of polyvinyl butyral type receptor coated on a support. A second variable was created by first coating an interfacial bonding layer having 2.5% FUSABOND A in solvent on top of the GT receptor using a #6 meyer bar. An image receiving layer using PILOLITE S5A in accordance with the present invention was then coated on top of the interfacial bonding layer with a #6 meyer bar.

Both variables were imaged using first a cyan color donor followed by a yellow color donor to obtain a green image on the receptor variable with a CREO TRENDSETTER unit using the following conditions:

| | Cyan Donor | Yellow Donor |
|---|---|---|
| Drum Speed | 160 | 170 |
| Wpower | 16.7 | 15.7 |
| SR | 80 | 65 |
| SD | 0.42 | 0.44 |

Both receptor variables were then laminated to a second support. Right after the receptor variables were laminated, color measurements were taken for both of the laminated receptor variables using a Gretag SPM 100, spectrophotometer. These color measurements from the spectrophotometer are provided in Table 5 and are listed as $L^*_1$, $a^*_1$ and $b^*_1$.

The laminated receptor variables were then subjected to temperature conditions of 95° C. for a time period of 3 minutes to accelerate the aging process to what would typically be observed after a three-day period of time. Color measurements were then taken again for both of the treated laminated receptor variables using a spectrophotometer. These color measurements from the spectrophotometer are provided in Table 5 and are listed as $L^*_2$, $a^*_2$ and $b^*_2$.

The color measurements recorded by the spectrophotometer are provided as values for L*, a* and b*. These values are representative of the "color space" of the laminated receptor variable and correspond to coordinates on an x, y and z-axis. From these values, ΔE can be calculated using the following formula:

$$SQRT[((L^*_1-L^*_2)^2+(a^*_1-a^*_2)^2+(b^*_1-b^*_2)^2)]$$

where $L^*_1$, $a^*_1$ and $b^*_1$ are measurements taken before aging and $L^*_2$, $a^*_2$ and $b^*_2$ are measurements taken after aging. ΔE indicates how much the color is shifting over time. The greater the value of ΔE, the greater the amount of color shifting.

TABLE 5

| | Color Shifting | | | | | | |
|---|---|---|---|---|---|---|---|
| Variable | $L^*_1$ | $L^*_2$ | $a^*_1$ | $a^*_2$ | $b^*_1$ | $b^*_2$ | ΔE |
| GT Receptor (control) | 49.55 | 51.56 | −61.12 | −66.15 | 22.09 | 22.79 | 5.45 |
| GT Receptor with coatings of Formula B and C1 (Three-layer laser thermal receptor sheet) | 51.43 | 52.55 | −61.72 | −64.31 | 23.43 | 23.55 | 2.82 |

What is claimed is:

1. A multi-layer thermal imaging receptor comprising:

a first support coated with at least:

a heat sensitive releasable transfer layer coated on the first support, wherein the heat sensitive releasable transfer layer further comprises a bleaching agent;

an interfacial bonding layer coated on the heat sensitive releasable transfer layer; and an image receiving layer coated on the interfacial bonding layer and adapted to adhere to a second support when heated;

wherein the interfacial bonding layer is adapted to enhance adhesion between the heat sensitive releasable transfer layer and the image receiving layer.

2. The multi-layer thermal imaging receptor of claim 1 wherein the first support is plain paper, coated paper, glass, polymeric films or mixtures thereof.

3. The multi-layer thermal imaging receptor of claim 1 wherein the first support is a polyester film.

4. The multi-layer thermal imaging receptor of claim 1 wherein the second support is plain paper, thin paper, coated paper, glass, polymeric films or mixtures thereof.

5. The multi-layer thermal imaging receptor of claim 1 wherein the second support is thin paper.

6. The multi-layer thermal imaging receptor of claim 1 wherein the heat sensitive releasable transfer layer is adapted to substantially separate from the first support upon heating.

7. The multi-layer thermal imaging receptor of claim 1 wherein the heat sensitive releasable transfer layer comprises polyvinyl butyral.

8. The multi-layer thermal imaging receptor of claim 7 wherein hydroxyl moieties of the polyvinyl butyral react with the interfacial bonding layer.

9. The multi-layer thermal imaging receptor of claim 7 wherein the polyvinyl butyral is present in an amount of from about 4.95 wt % to about 20 wt % based on the total weight of the heat sensitive releasable transfer layer.

10. The multi-layer thermal imaging receptor of claim 1 wherein the bleaching agent is adapted to bleach infrared dye.

11. The multi-layer thermal imaging receptor of claim 1 wherein the bleaching agent crystallizes in the image receiving layer at ambient temperature.

12. The multi-layer thermal imaging receptor of claim 1 wherein the bleaching agent is soluble in methyl ethyl ketone.

13. The multi-layer thermal imaging receptor of claim 1 wherein the bleaching agent is diphenylguanidine.

14. The multi-layer thermal imaging receptor of claim 1 wherein the interfacial bonding layer is adapted to permit migration of the bleaching went from the heat sensitive releasable transfer layer into the image receiving layer upon heating.

15. The multi-layer thermal imaging receptor of claim 1 wherein the bleaching agent is present in an amount of from about 2 to about 22 wt % based on the total weight of the heat sensitive releasable transfer layer.

16. The multi-layer thermal imaging receptor of claim 1 wherein the heat sensitive releasable transfer layer further comprises a texturizing material.

17. The multi-layer thermal imaging receptor of claim 16 wherein the texturizing material comprises polymethyl methacrylate beads.

18. The multi-layer thermal imaging receptor of claim 17 wherein the polymethyl methacrylate beads are present in an amount of from about 0.05 wt % to about 3.0 wt % based on the total weight of the transfer layer.

19. The multi-layer thermal imaging receptor of claim 1 wherein the heat sensitive releasable transfer layer is a thin film, solvent extruded coating.

20. The multi-layer thermal imaging receptor of claim 19 wherein the solvent is methyl ethyl ketone.

21. The multi-layer thermal imaging receptor of claim 1 wherein the interfacial bonding layer comprises a maleic anhydride modified ethylene copolymer.

22. The multi-layer thermal imaging receptor of claim 1 wherein the interfacial bonding layer is a thin film, solvent extruded coating.

23. The multi-layer thermal imaging receptor of claim 22 wherein the solvent is toluene or a solvent blend of toluene and methyl ethyl ketone.

24. The multi-layer thermal imaging receptor of claim 1 wherein the image receiving layer is further adapted to be tack-free at ambient conditions.

25. The multi-layer thermal imaging receptor of claim 1 wherein the image receiving layer is further adapted to be color stable.

26. The multi-layer thermal imaging receptor of claim 1 wherein the image receiving layer comprises a thermoplastic adhesive.

27. The multi-layer thermal imaging receptor of claim 26 wherein the thermoplastic adhesive is present in an amount of from about 4.95 wt % to about 38 wt % based on the total weight of the thermoplastic adhesive image receiving layer.

28. The multi-layer thermal imaging receptor of claim 1 wherein the image receiving layer comprises styrene butadiene.

29. The multi-layer thermal imaging receptor of claim 28 wherein the styrene butadiene reacts with hydrophobic moieties of the interfacial bonding layer.

30. The multi-layer thermal imaging receptor of claim 1 wherein the image receiving layer comprises a plasticizer.

31. The multi-layer thermal imaging receptor of claim 30 wherein the plasticizer is present in an amount of from about 0.05 wt % to about 10 wt % based on the total weight of the image receiving layer.

32. The multi-layer thermal imaging receptor of claim 1 wherein the image receiving layer is a thin film solvent extruded coating.

33. The multi-layer thermal imaging receptor of claim 32 wherein the solvent is toluene.

34. A multi-layer thermal imaging receptor comprising:
- a first support coated with at least:
  - a heat sensitive releasable transfer layer coated on the first support comprising:
    - polyvinyl butyral;
    - a bleaching agent; and
    - a texturizing material
  - an interfacial bonding layer covering the heat sensitive releasable transfer layer comprising:
    - a maleic anhydride modified ethylene copolymer; and
  - an image receiving layer covering the interfacial bonding layer and adapted to adhere to a second support when heated comprising:
    - styrene butadiene; and
    - a plasticizer;

wherein the interfacial bonding layer is adapted to enhance adhesion between the heat sensitive releasable transfer layer and the image receiving layer.

35. The multi-layer thermal imaging receptor of claim 34 wherein the first support is plain paper, coated paper, glass, polymeric films or mixtures thereof.

36. The multi-layer thermal imaging receptor of claim 34 wherein the substrate is a polyester film.

37. The multi-layer thermal imaging receptor of claim 34 wherein the bleaching agent of the heat sensitive releasable transfer layer is diphenylguanidine.

38. The multi-layer thermal imaging receptor of claim 34 wherein the texturizing material of the heat sensitive releasable layer is polymethyl methacrylate beads.

39. A multi-layer thermal imaging receptor comprising:
- a first support coated with at least:
  - a heat sensitive releasable transfer layer coated on the first support;
  - an interfacial bonding layer coated on the heat sensitive releasable transfer layer; and
  - an image receiving layer coated on the interfacial bonding layer and adapted to adhere to a second support when heated, wherein the image receiving layer comprises styrene butadiene;

wherein the interfacial bonding layer is adapted to enhance adhesion between the heat sensitive releasable transfer layer and the image receiving layer.

40. A multi-layer thermal imaging receptor comprising:
- a first support coated with at least:
  - a heat sensitive releasable transfer layer coated on the first support;
  - an interfacial bonding layer coated on the heat sensitive releasable transfer layer; and
  - an image receiving layer coated on the interfacial bonding layer and adapted to adhere to a second support when heated;

wherein the interfacial bonding layer comprises a maleic anhydride modified ethylene copolymer and is adapted to enhance adhesion between the heat sensitive releasable transfer layer and the image receiving layer.

* * * * *

UNITED STATES PATENT AND TRADEMARK OFFICE

CERTIFICATE OF CORRECTION

PATENT NO. : 7,147,902 B2
APPLICATION NO. : 10/789039
DATED : December 12, 2006
INVENTOR(S) : Kevin M. Kidnie et al.

It is certified that error appears in the above-identified patent and that said Letters Patent is hereby corrected as shown below:

Column 20, Line 59 In Claim 18, delete "claim 17" and insert -- claim 16 --.

Signed and Sealed this

Sixth Day of May, 2008

JON W. DUDAS
*Director of the United States Patent and Trademark Office*